US006309328B1

(12) United States Patent
Dudley

(10) Patent No.: US 6,309,328 B1
(45) Date of Patent: Oct. 30, 2001

(54) EXERCISE DEVICE

(76) Inventor: David Edmond Dudley, 2673 Million Ct., San Jose, CA (US) 95148

( * ) Notice: Subject to any disclaimer, the term of this patent is extended or adjusted under 35 U.S.C. 154(b) by 57 days.

(21) Appl. No.: 09/684,687

(22) Filed: Oct. 7, 2000

(51) Int. Cl.[7] ..... A63B 21/012; A63B 21/018
(52) U.S. Cl. ..... 482/120; 482/114
(58) Field of Search ..... 482/114, 120, 482/115–119, 148; 188/65.1, 65.2, 65.3, 65.4

(56) References Cited

U.S. PATENT DOCUMENTS 3,596,907 * 8/1971 Brighton ..... 272/83 A
4,040,627 * 8/1977 Useldinger ..... 272/133
4,114,875 * 9/1978 Deluty ..... 272/133
4,174,832 * 11/1979 Thompson ..... 272/133
4,557,480 * 12/1985 Dudley ..... 272/133

* cited by examiner

*Primary Examiner*—Stephen R. Crow
(74) *Attorney, Agent, or Firm*—Richard B. Main

(57) ABSTRACT

An exercise device comprises a housing with a self-rewinding spool of cord. The cord is threaded out between a pair of inner wedgeblocks that can move together and pinch the cord. The amount of pinch applied determines how much resistance will be applied when the user exercises by pulling out the cord on handles. The inner wedgeblocks are disposed between a pair of outer fixed wedgeblocks. Facing channels in the interfaces between the inner and outer wedgeblocks have ball bearings that run on inclined ramps. When the inner wedgeblocks are pulled by the cord out of alignment with the outer wedgeblocks, the inclined ramps and ball bearings press the inner wedgeblocks together. The more they press together, the more the cord resists being pulled out. An adjustment limits how far the inner wedgeblocks can move out of alignment.

5 Claims, 2 Drawing Sheets

EXERCISE DEVICE

BACKGROUND OF THE INVENTION

1. Field of the Invention

The present invention relates to exercise equipment, and more particularly to resistance-training devices that use cables or ropes drawn out from an anchored housing.

2. Description of Related Art

A portable exercise device is described by Edmond R. Dudley, in U.S. Pat. No. 4,557,480, issued Dec. 10, 1985. Such device is intended for arm and leg exercises in which a cord resists being pulled from a housing. A handle or strap is provided for the user's hands and feet, and another end is anchored to a doorway or other fixed object. An internal self-rewinding spool takes up any slack in the cord. The cord makes a right-angle turn inside around a rubbing block before entering between a pair of pinching wedges. These wedges are caged inside opposing rollers. As the cord is drawn out of the housing, the wedges move forward and are squeezed harder and harder by action of the rollers trying to climb the wedges' inclined ramps. An adjustment limits how far the wedges can travel, and thus how tightly the cord can be pinched. This adjustment sets the training level for the resistance presented to the user.

Such exercise device has proven effective in numerous user tests, but strong-enough axles and mounts for the rollers have been hard to implement in an affordable, mass-produced version. Such axles, mounts, and their rollers concentrate too much force for the typical yield strengths of polycarbonate and other plastics. Metal castings and machining are generally much more expensive than plastic-molded pieces. What is needed is a portable exercise device like that described by Edmond R, Dudley, but with a more readily producible mechanism.

SUMMARY OF THE INVENTION

An object of the present invention is to provide an exercise device for resistance training of a user's arms, legs, abdomen, and back.

Another object of the present invention is to provide an exercise device that can be inexpensively manufactured from readily obtainable commercial materials.

A further object of the present invention is to provide an exercise device that can be adjusted to provide a variety of resistance training levels.

Briefly, an exercise device embodiment of the present invention comprises a housing with a self-rewinding spool of cord. The cord is threaded out between a pair of inner wedgeblocks that can move together and pinch the cord. The amount of pinch applied determines how much resistance will be applied when the user exercises by pulling out the cord on handles. The inner wedgeblocks are disposed between a pair of outer fixed wedgeblocks. Facing channels in the interfaces between the inner and outer wedgeblocks have ball bearings that run on inclined ramps. When the inner wedgeblocks are pulled by the cord out of alignment with the outer wedgeblocks, the inclined ramps and ball bearings press the inner wedgeblocks together. The more they press together, the more the cord resists being pulled out. An adjustment limits how far the inner wedgeblocks can move out of alignment.

An advantage of the present invention is that an exercise device is provided that is effective.

Another advantage of the present invention is that an exercise device is provided that can be manufactured easily and inexpensively.

A still further advantage of the present invention is that an exercise device is provided that permits a range of user adjustments.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
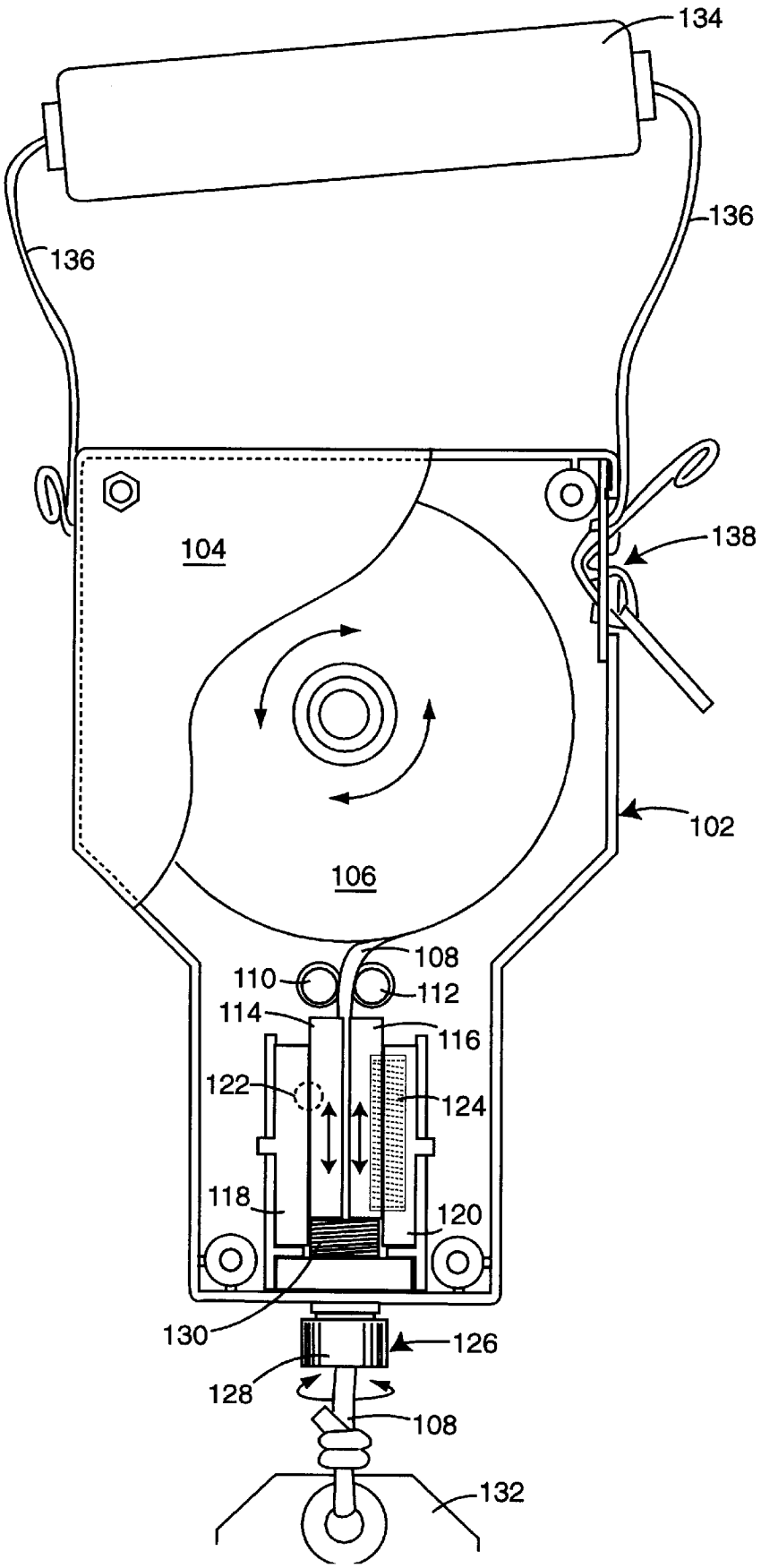
FIG. 1 is a plan view diagram of a portable exercise device embodiment of the present invention.

FIG. 1 represents an exercise device embodiment of the present invention, and is referred to herein by the general reference numeral 100. The exercise device 100 comprises a bottom housing half 102 and a top housing half 104 that are joined together by screws. A reel assembly 106 is self-rewinding and takes up a cord 108 guided by two fairlead rollers 110 and 112. The cord 108 can comprise a rope and follows inside two opposite grooves in two mobile wedge blocks 114 and 116. A pair of stationary wedge blocks 118 and 120 are captured by the housing halves 102 and 104 and are firmly anchored within. Wedge blocks 114, 116, 118, and 120 are preferably made of metal, e.g., aluminum or steel.

A ball bearing 122 represents several such ball bearings that are captured in corresponding inclined channels in adjacent faces of wedge blocks 114 and 118, and also wedge blocks 116 and 120. A spring 124 is placed inside either of wedge blocks 114 and 118, and wedge blocks 116 and 120. It will initiate a pinch force on the cord 108 between blocks 114 and 116. As the two mobile wedge blocks 114 and 116 are drawn by and with the cord 108 out of the housing, the ball bearings 122 ride up respective inclined channel-run bottoms and press the wedge blocks closer together. A pinching action develops which resists the pulling of the cord 108 out of the housing.

The amount of such resistance is proportional to how far the two mobile wedge blocks 114 and 116 are allowed to move out of alignment with the two stationary wedge blocks 118 and 120. An adjustment 126 has a knob 128 that turns a hollow threaded shaft 130. The end of the shaft 130 acts as a limit for the two mobile wedge blocks 114 and 116. More resistance is developed when the adjustment 126 is backed out and the end of the hollow threaded shaft 130 allows the two mobile wedge blocks 114 and 116 to move farther out of alignment with the two stationary wedge blocks 118 and 120. This allows the ball bearings to ride up further and the two mobile wedge blocks 114 and 116 to be pinched together tighter. Such pinching increases the friction the cord 108 experiences when trying to withdraw from the housing.

A strap 132 is connected to a distal end of the cord 108 and provides a convenient grip for a user to do exercises with the device 100. A handle 134 is connected to the housings 102 and 104 with an adjustable belt 136. A belt adjustment 138 permits the handle 134 to be anchored to a variety of fixed objects.

Figure 2A:
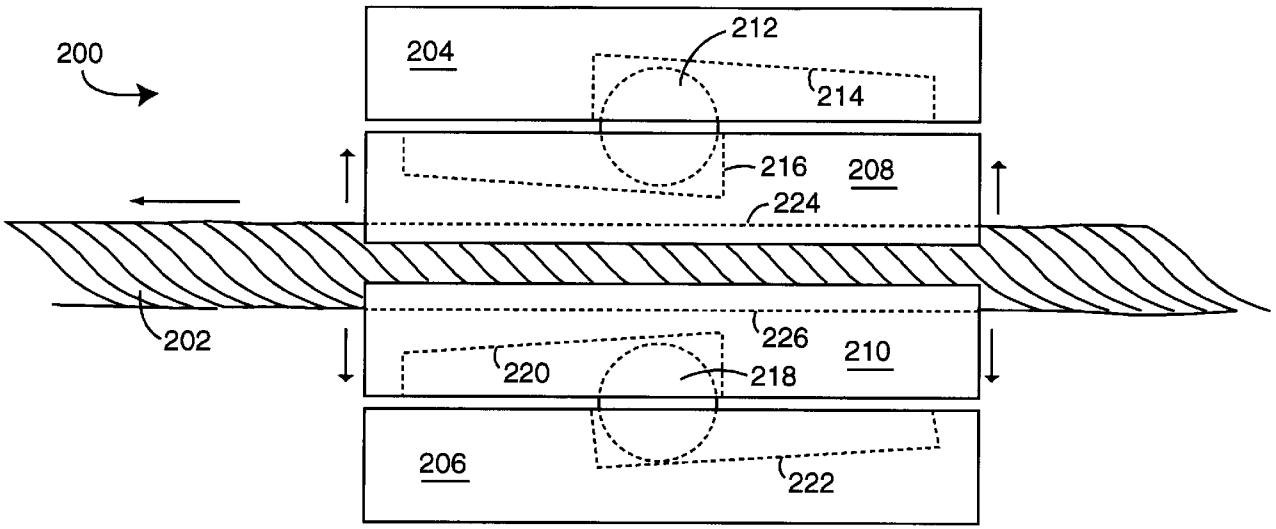
FIGS. 2A and 2B show details of the cord-movement resistance device.
Figure 2B:
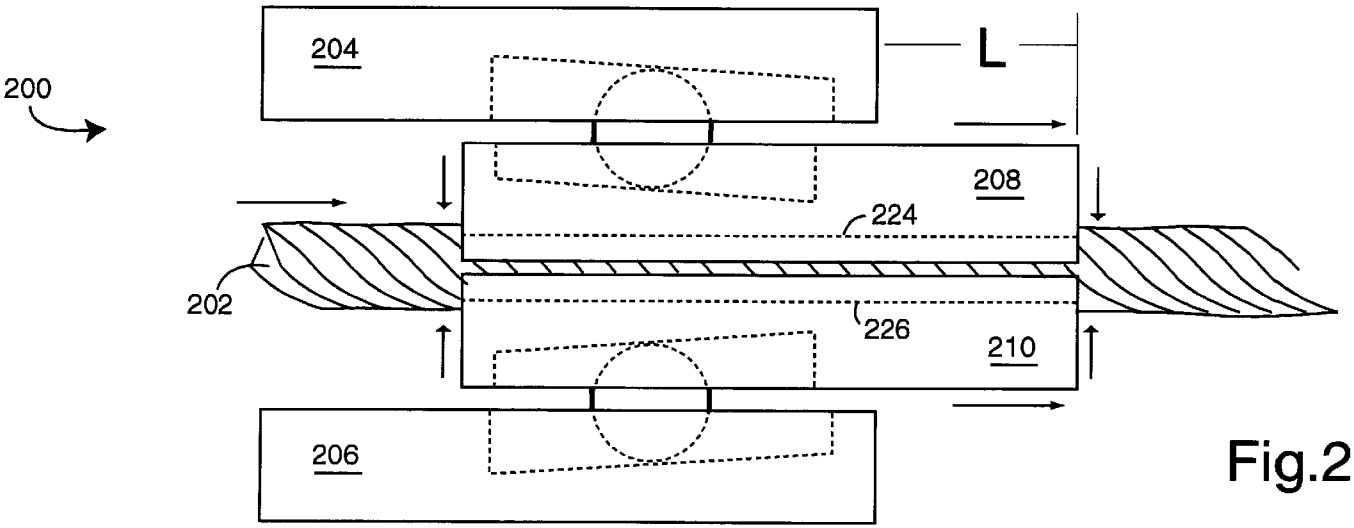

FIGS. 2A and 2B represent a cord-movement resistance device 200 that can be included in the exercise device 100

(FIG. 1). A cord 202 is able to move to the left fairly freely (FIG. 2A) and meets a measured amount of resistance when pulled to the right (FIG. 2B). A pair of fixed blocks 204 and 206 are mounted to an anchor or foundation, and do not move. A pair of mobile blocks 208 and 210 are disposed between, and can move left and right. A wedge mechanism squeezes these together when the mobile blocks 208 and 210 move to the right relative to the fixed blocks 204 and 206, as in FIG. 2B.

A first ball bearing 212 runs in opposing channels 214 and 216 with inclined bottom runs. These inclined bottom runs are oriented such that they shallow the ball bearing as the mobile blocks 208 and 210 move to the right. Such inclined bottom runs are preferred to have a combined angle of inclination of about 7°. A typical ball bearing is a quarter of an inch in diameter. A second ball bearing 218 runs in similar opposing channels 220 and 222 with inclined bottom runs. These inclined bottom runs too are oriented such that they shallow the ball bearing as the mobile blocks 208 and 210 move to the right. The consequence is that the mobile blocks 208 and 210 are squeezed together as they move to the right relative to the fixed blocks 204 and 206.

When the cord is slipping past the mobile blocks 208 and 210, it does so in grooves 224 and 226. The friction of the cord between the blocks is a function of the area of contact, surface textures, and pressure of contact. The pressure of contact is used to vary the friction, and thus the resistance presented to cord withdrawal. Limits can be placed on a distance "L" the mobile blocks 208 and 210 are allowed to move out of alignment with the fixed blocks 204 and 206. Such limits will directly affect how far the squeezing of the mobile blocks can proceed.

In preferred embodiments of the present invention, the mobile blocks 208 and 210 are loosely pinned or keyed to one another so that they move together longitudinally. A transverse curve or wave in the grooves 224 and 226 may also be included to always provide some drag on the cord. In such case, the spring 124 may not be necessary.

Alternative embodiments of the present invention may include a ball bearing in an inclined channel in each of four corners of the mobile blocks 208 and 210. Such would help maintain a parallelism between the blocks. Other embodiments of the present invention may include the use of cylindrical rollers instead of ball bearings.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A cord-movement resistance device, comprising:

a pair of fixed wedge blocks;

a pair of mobile wedge blocks disposed adjacent to one another and in between the fixed wedge blocks;

a cord disposed for linear movement between the pair of mobile wedge blocks;

a facing pair of channels with inclined bottom runs respectively disposed in opposite faces of each of two interfaces between the fixed and mobile wedge blocks; and at least one ball bearing disposed in each facing pair of channels;

wherein, a linear movement of the mobile wedge blocks relative to the fixed wedge blocks induced by a withdrawal of the cord causes the ball bearings to ride up said inclined bottom runs and thus force the mobile wedge blocks together and pinch the cord.

2. The device of claim 1, further comprising:

an adjustment that provide for regulation of an amount of pinching force that can be applied by the mobile wedge blocks on the cord to increase friction.

3. The device of claim 1, wherein:

the adjustment includes a threaded screw that limits how far the mobile wedge blocks can move relative to the fixed wedge blocks, and thereby controls said pinching force that can be applied on the cord to increase friction.

4. A portable exercise device, comprising:

a housing with an anchor strap;

a pair of fixed wedge blocks disposed within the housing;

a pair of mobile wedge blocks disposed adjacent to one another and in between the fixed wedge blocks, and further including guide grooves;

a cord disposed for linear movement in said guide grooves and between the pair of mobile wedge blocks, and further connected to an external handle;

a facing pair of channels with inclined bottom runs respectively disposed in opposite faces of each of two interfaces between the fixed and mobile wedge blocks;

at least one ball bearing disposed in each facing pair of channels; and a user adjustment for providing a variation in an amount of pinching force that can be applied by the mobile wedge blocks on the cord to increase friction;

wherein, a linear movement of the mobile wedge blocks relative to the fixed wedge blocks induced by a withdrawal of the cord causes the ball bearings to ride up said inclined bottom runs and thus force the mobile wedge blocks together and pinch the cord.

5. The device of claim 4, wherein:

the user adjustment includes an external knob and a hollow threaded screw that limits how far the mobile wedge blocks can move relative to the fixed wedge blocks, and is such that a user can dial-in a different resistance-training level.

* * * * *